US011131173B2

(12) United States Patent
Broussard et al.

(10) Patent No.: US 11,131,173 B2
(45) Date of Patent: Sep. 28, 2021

(54) PUMP SYSTEM FOR GAS ENTRAINMENT

(71) Applicant: Siemens Energy, Inc., Orlando, FL (US)

(72) Inventors: Shane Broussard, Youngsville, LA (US); Bruce M. Schertz, Weston, WI (US); Chad L. Felch, Kronenwetter, WI (US)

(73) Assignee: SIEMENS ENERGY, INC., Orlando, FL (US)

( * ) Notice: Subject to any disclaimer, the term of this patent is extended or adjusted under 35 U.S.C. 154(b) by 26 days.

(21) Appl. No.: 16/784,698

(22) Filed: Feb. 7, 2020

(65) Prior Publication Data

US 2020/0256172 A1 Aug. 13, 2020

Related U.S. Application Data

(60) Provisional application No. 62/872,818, filed on Jul. 11, 2019, provisional application No. 62/802,261, filed on Feb. 7, 2019.

(51) Int. Cl.

| | |
|---|---|
| ***E21B 43/25*** | (2006.01) |
| ***E21B 43/16*** | (2006.01) |
| ***E21B 43/12*** | (2006.01) |
| ***E21B 43/40*** | (2006.01) |
| *E21B 43/38* | (2006.01) |

(52) U.S. Cl.
CPC ..... *E21B 43/255* (2013.01); *E21B 43/124* (2013.01); *E21B 43/164* (2013.01); *E21B 43/166* (2013.01); *E21B 43/40* (2013.01); *E21B 43/38* (2013.01)

(58) Field of Classification Search
CPC .... E21B 43/166; E21B 43/255; E21B 43/164; E21B 43/124; E21B 43/40
See application file for complete search history.

(56) References Cited

U.S. PATENT DOCUMENTS 3,065,790 A * 11/1962 Holm ..... E21B 43/164 166/402
2011/0048546 A1* 3/2011 Bjorge ..... F04D 29/05 137/154
2016/0245290 A1* 8/2016 Pemberton ..... F04D 13/04

* cited by examiner

*Primary Examiner* — D. Andrews

(57) ABSTRACT

A pump system includes a centrifugal pump having an impeller, a first inlet arranged to receive a first flow of liquid, a second inlet arranged to receive a flow of gas at a first pressure, the gas being soluble in the liquid, and an outlet arranged to discharge a second flow of liquid that contains the flow of gas solubilized therein. An injection pump has an inlet arranged to receive the second flow of liquid. The injection pump is operable to increase the pressure of the second flow of liquid to produce a high-pressure flow of liquid, and includes a discharge arranged to discharge the high-pressure flow of liquid.

18 Claims, 6 Drawing Sheets

PUMP SYSTEM FOR GAS ENTRAINMENT

BACKGROUND

Aspects and embodiments relate to an entrainment system and method. More particularly, aspects and embodiments relate to a gas entrainment system and method, for example, a carbon dioxide or water-soluble gas entrainment system and method.

The recovery of oil from wells can be greatly enhanced through the use of recovery techniques including the delivery of high-pressure gas or liquid into the wells. In some cases, alternating injections of gas and liquids are employed. The result is often a three-phase liquid that is returned from the well. In conventional systems, the hydrocarbons and the gas are separated from the liquid and the liquid is collected for reuse.

BRIEF SUMMARY

In accordance with one aspect, there is provided a system for producing a single-phase gas entrained aqueous solution. The system may comprise a dual-sided impeller pump having an inlet fluidly connectable to a source of water and a source of gas. The pump may be configured to pressurize the gas to at least 95% dissolution in the water. The gas may have a greater solubility in water than air. In some embodiments, the gas may have a greater solubility in water than carbon dioxide.

In accordance with another aspect, there is provided a system for enhanced oil recovery from an oil recovery well. The system may comprise a holding tank having an inlet fluidly connected to a source of produced water comprising carbon dioxide and an outlet. The system may comprise a pump having an inlet fluidly connected to the outlet of the holding tank and an outlet. The pump may be configured to pressurize the carbon dioxide to produce a single-phase gas entrained aqueous solution. The system may comprise a fluid injection pump having an inlet fluidly connected to the outlet of the pump, and an outlet. The fluid injection pump may be configured to re-inject the single-phase gas entrained aqueous solution into the oil recovery well.

In accordance with another aspect, there is provided a method of producing a single-phase gas entrained aqueous solution. The method may comprise pumping an aqueous solution and a gas through a dual-sided impeller pump configured to pressurize the gas to at least 95% dissolution in the water.

In accordance with another aspect, there is provided a method of facilitating gas re-injection during enhanced oil recovery. The method may comprise providing a pump configured to pressurize a gas to produce a single-phase gas entrained solution. The method may comprise fluidly connecting the pump to a source of produced water comprising carbon dioxide. In some embodiments, the method may comprise fluidly connecting the pump to a fluid injection pump configured to reinject the single-phase gas entrained solution into an oil recovery well.

In accordance with yet another aspect, there is provided a method of retrofitting a gas injection enhanced oil recovery system comprising a fluid injection pump. The method may comprise providing a pump configured to pressurize a gas to produce a single-phase gas entrained solution. The method may comprise fluidly connecting the pump to a source of produced water comprising carbon dioxide. In some embodiments, the method may comprise fluidly connecting the pump to a fluid injection pump configured to reinject the single-phase gas entrained solution into an oil recovery well.

In one construction, a pump system includes a centrifugal pump having an impeller, a first inlet arranged to receive a first flow of liquid, a second inlet arranged to receive a flow of gas at a first pressure, the gas being soluble in the liquid, and an outlet arranged to discharge a second flow of liquid that contains the flow of gas solubilized therein. An injection pump has an inlet arranged to receive the second flow of liquid. The injection pump is operable to increase the pressure of the second flow of liquid to produce a high-pressure flow of liquid, and includes a discharge arranged to discharge the high-pressure flow of liquid.

In another construction, a method of operating a pump system includes directing a first flow of liquid to a centrifugal pump, directing a flow of gas at a first pressure to the centrifugal pump, the flow of gas being soluble in the liquid, and rotating an impeller in the centrifugal pump to increase the pressure of the first flow of liquid and the flow of gas. The method also includes discharging a second flow of liquid that contains the flow of gas solubilized therein, directing the second flow of liquid to an injection pump, and operating the injection pump to inject the second flow of liquid into an oil well to enhance oil production.

In yet another arrangement, a pump system includes a three-phase separator positioned to receive a produced fluid mixture from an oil well, the fluid mixture including a hydrocarbon liquid, a gas, and water, the three-phase separator including a gas outlet, a separate hydrocarbon outlet, and a water outlet. A holding tank is positioned to receive the water from the water outlet, the water including a quantity of solubilized gas that de-solubilizes in the holding tank such that the holding tank contains separated water and gas. A centrifugal pump includes a dual sided impeller including a first side impeller and a second side impeller coupled to one another for co-rotation, a first inlet arranged to receive a first flow of water from the holding tank and to direct the first flow of water to the first side impeller, a second inlet arranged to receive a flow of gas from the holding tank at a first pressure and to direct the flow of gas to the second side impeller, and an outlet arranged to discharge a second flow of liquid that contains the flow of gas solubilized therein. An injection pump has an inlet arranged to receive the second flow of liquid, a working member operable to increase the pressure of the second flow of liquid to produce a high-pressure flow of liquid, and an outlet arranged to discharge the high-pressure flow of liquid to the oil well.

BRIEF DESCRIPTION OF THE DRAWINGS

To easily identify the discussion of any particular element or act, the most significant digit or digits in a reference number refer to the figure number in which that element is first introduced.

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
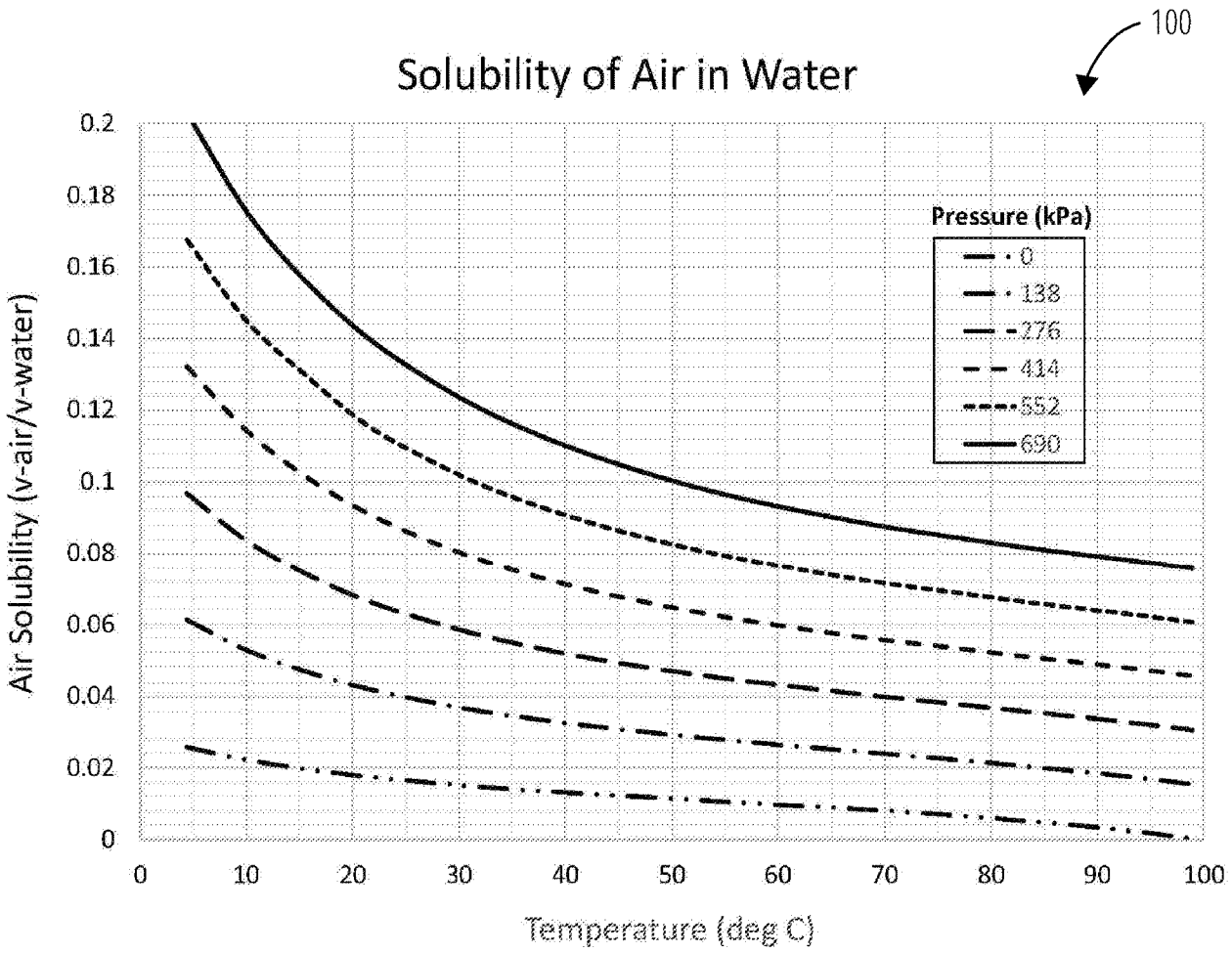
FIG. 1 illustrates a graph of the solubility of air in water by temperature and gauge pressure 100.

Aspects and embodiments are not limited in their application to the details of construction and the arrangement of components set forth in the following description or illustrated in the drawings. Aspects and embodiments disclosed herein are capable of other embodiments and of being practiced or of being carried out in various ways. Also, the phraseology and terminology used herein is for the purpose of description and should not be regarded as limiting. The use of "including," "comprising," "having," "containing," "involving," and variations thereof herein is meant to encompass the items listed thereafter and equivalents thereof as well as additional items.

Embodiments, principles, and features are described herein with reference to implementation in illustrative embodiments. In particular, certain embodiments disclosed herein are described in the context of being an entrainment system. Certain embodiments disclosed herein are described in the context of being an oil recovery system. Aspects and embodiments, however, are not limited to use in the described exemplary systems. The components and materials described herein as making up the various embodiments are intended to be illustrative and not restrictive. Many suitable components and materials that would perform the same or a similar function as the materials described herein are intended to be embraced within the scope of the disclosure.

In some embodiments, the devices, systems, and methods disclosed herein provide advantages with regard to, for example, capital costs, operational costs, system footprint and environmental-friendliness as compared to conventional gas entrainment systems. In particular, the devices, systems, and methods disclosed herein provide such advantages as compared to conventional gas injection enhanced oil recovery systems.

Unless otherwise explicitly stated, all pressures are gauge pressures.

Figure 5:
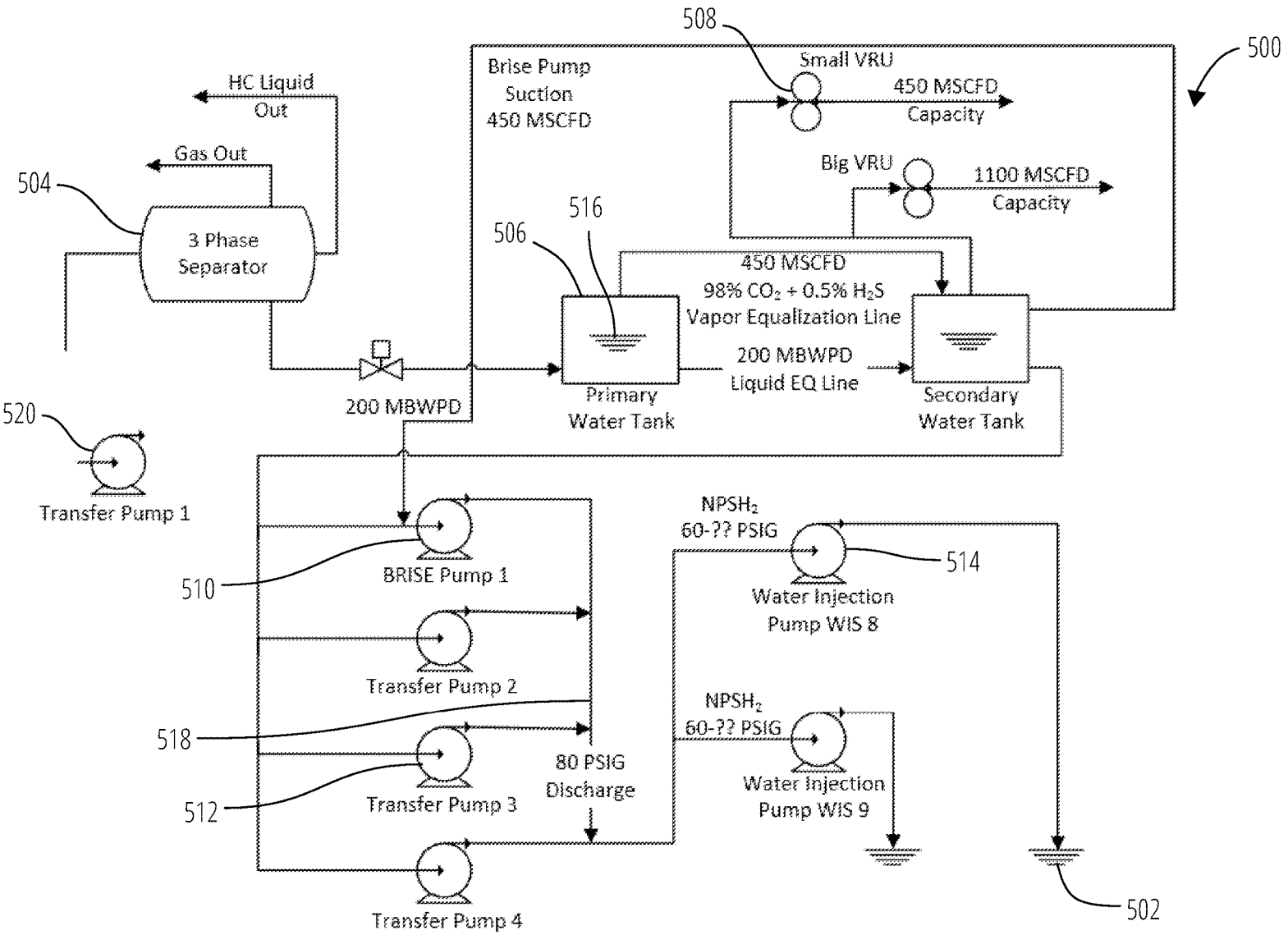
FIG. 5 illustrates a system for enhanced oil recovery from an oil well 500.

Injecting a gas into oil formations is one method of performing enhanced oil recovery. FIG. 5 illustrates a system for enhanced oil recovery from an oil well 500. Typically, a gas (carbon dioxide) is injected into the oil formation to dissolve oil and improve release and recovery of the oil. The process may include a series of alternating injections with the gas and water. A liquid, often referred to as produced water, is recovered from the well and includes the dissolved oil and gas.

With reference to FIG. 5, the system for enhanced oil recovery from an oil well 500 includes one or more injection pumps 514 arranged to inject a gas, a liquid, a gas/liquid combination, or a liquid containing a solubilized gas into an oil well 502 at a high pressure. While the remainder of this description will discuss water including solubilized carbon dioxide, other liquids and gasses could be employed. As discussed, the carbon dioxide and high-pressure water aid in the recovery of oil which is drawn from the oil well 502 in the form of a produced liquid, often referred to as produced water as the injection pumps 514 operate.

The produced liquid is directed from the oil well 502 to a separator 504 in the form of a three-phase separator 504. The separator 504 includes a hydrocarbon outlet that discharges oil separated from the produced liquid. A gas outlet is provided to discharge any separated gas, including the carbon dioxide that separates from the produced liquid. A third outlet directs the remaining liquid, typically water with some quantity of solubilized carbon dioxide to a holding tank 506.

The holding tank 506 illustrated in FIG. 5 includes a primary water tank and a secondary water tank. However, it should be understood that a single tank or a plurality of separate tanks could be employed as the holding tank 506. The holding tank 506 receives the remaining liquid from the separator 504 and holds it for re-use in the injection process. While the liquid is held, certain gases, for example, carbon dioxide ($CO_2$), entrained in the produced water may break out into a head space 516 of the holding tank 506.

Vapor recovery units 508 (VRUs) are used to gather the released gas from the head space 516 and send it to other areas for safe handling or reuse. FIG. 5 illustrates two vapor recovery units 508, however, it should be clear that a single vapor recovery unit 508 or more than two vapor recovery units 508 could be employed as required by the system. The vapor recovery units 508 may collect the gas from the head space 516 of the holding tank 506 and compress it. The compressed gas may be sent to a storage and processing area for further treatment or may be reused.

In conventional arrangements, the vapor recovery units 508 are periodically taken out of service for maintenance. During maintenance, a temporary vapor recovery unit 508 is installed to continue operation. Bringing the temporary vapor recovery unit 508 to the field and installing it can be very costly and time consuming.

FIG. 5 illustrates an arrangement in which a temporary or replacement vapor recovery unit 508 is not required. In addition, the system illustrated in FIG. 5 can replace the need for some or all the vapor recovery units 508 for gas recovery and reuse.

FIG. 5 illustrates two vapor recovery units 508 that extract and compress gas from the head space 516 of the holding tank 506. However, a dual phase pump 510 is also provided in the system of FIG. 5. The dual phase pump 510 includes a first inlet that receives gas from the head space 516 of the holding tank 506. A second inlet provides liquid from the holding tank 506 to the dual phase pump 510. As will be discussed in greater detail, the dual phase pump 510 is preferably a centrifugal pump that operates to combine the gas and liquid into a single-phase output flow that is discharged from the dual phase pump 510 into a collection manifold 518. FIG. 5 also illustrates one or more transfer pumps 512 that operate to deliver liquid from the holding tank 506 to the collection manifold 518. The transfer pumps 512 are designed for pumping liquid only and cannot deliver a significant quantity of gas without damaging or degrading the transfer pump 512.

From the collection manifold 518, the fluid (e.g., water with solubilized carbon dioxide) is directed to one or more injection pumps 514. The injection pumps 514 operate to inject the fluid into the oil well 502 at high pressure to complete the cycle.

Embodiments disclosed herein generally relate to devices, systems, and methods that may replace conventional compressing and storage steps of gas, and instead provide immediate solubilization of the gas. For example, embodiments disclosed herein may provide solubilization of a gas into a single-phase aqueous stream that can be processed for further use. In some embodiments, the further use may include re-injecting the gas into an oil recovery well.

In certain embodiments, there is provided a method of producing a single-phase gas entrained aqueous solution.

The method may comprise pumping an aqueous solution and a gas through a dual-sided impeller pump (e.g., the dual phase pump 510). The dual phase pump 510 may be capable of dissolving a greater volume of gas in the fluid than conventional pumps used for gas entrainment. The systems and methods may comprise or be capable of solubilizing a gas to at least about 90% dissolution in water. For example, the systems and methods may comprise or be capable of solubilizing the gas to at least about 91%, about 92%, about 93%, about 94%, about 95%, about 96%, about 97%, about 98%, or about 99%. Systems and methods disclosed herein may comprise or be capable of solubilizing the gas to at least about 99.9%, about 99.99%, or about 99.999% in water. In certain embodiments, the systems and methods may be capable of solubilizing a gas to more than its saturation.

Gases which may be solubilized by the systems and methods disclosed herein generally include gases with a higher solubility in water than air. The solubility of a gas in water may vary by temperature and gauge pressure. FIG. 1 includes a graph illustrating the solubility of air in water by temperature and gauge pressure 100. Specifically, FIG. 1 illustrates the solubility of air in water versus temperature for various pressures. In some embodiments, the gases may have a higher solubility in water than $CO_2$. Exemplary gases which may be solubilized by the systems and methods disclosed herein are listed in Table 1.

TABLE 1 solubility of exemplary gases in water. The solubility in Table 1 has units of grams of gas dissolved in 100 g of water, when the total pressure above the solution is 1 atm.

| Gas | Solubility |
|---|---|
| Acetylene | 0.117 |
| Ammonia | 52.9 |
| Bromine | 14.9 |
| Carbon dioxide | 0.169 |
| Carbon monoxide | 0.0028 |
| Chlorine | 0.729 |
| Ethane | 0.0062 |
| Ethylene | 0.0149 |
| Hydrogen | 0.00016 |
| Hydrogen sulfide | 0.385 |
| Methane | 0.0023 |
| Nitrogen | 0.0019 |
| Oxygen | 0.0043 |
| Sulfur Dioxide | 11.28 |

In accordance with certain aspects, there is provided the dual phase pump 510 for producing a single-phase gas entrained aqueous solution. As disclosed herein, single-phase refers to a fluid having no visible gas. The dual phase pump 510 may be configured to dissolve gas in water. In general, the dual phase pump 510 may be configured to pressurize the gas to at least 90% dissolution, for example at least 95% dissolution, as previously described herein. The dual phase pump 510 may pressurize the gas to produce a single-phase gas entrained aqueous solution.

Figure 6:
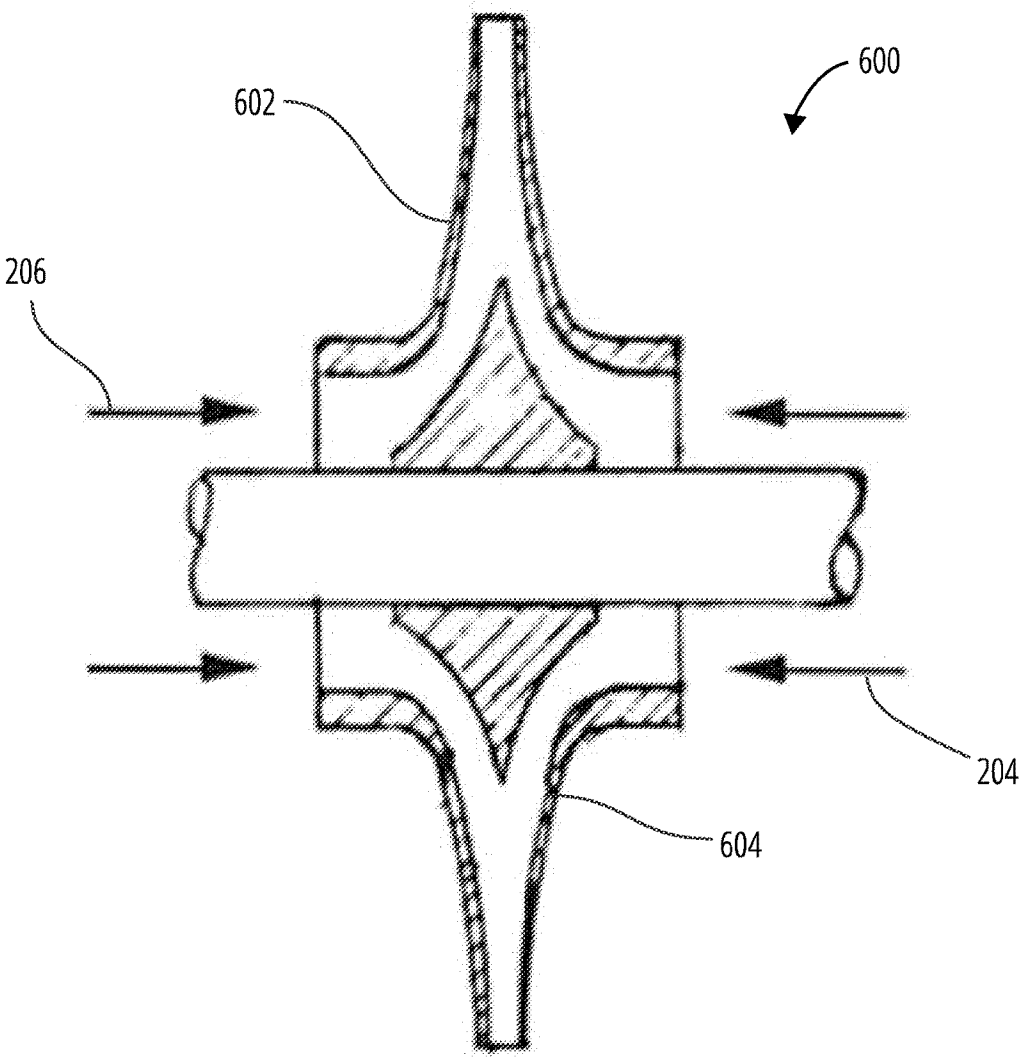
FIG. 6 illustrates a dual-sided impeller 600 for use with the pumps of FIGS. 2-5.

In certain embodiments, the dual phase pump 510 may have a dual-sided impeller 600 shown in FIG. 6. The dual-sided impeller 600 is an exemplary design which may enable the dual phase pump 510 to pull multiple phases, for example, water and gas, and mix them under pressure to produce a single-phase discharge. More specifically, a first impeller 602 is arranged to receive and pump or compress the gas received from the source of gas 206 while a second impeller 604, coupled to the first impeller 602 for co-rotation is arranged to receive the liquid from the source of water 204 and pump it during operation. The two impellers 602, 604 discharge their respective fluid to a common outlet where they are mixed, and the gas is solubilized into the liquid. A dual phase pump 510 having the dual-sided impeller 600 design may be capable of drawing more gas than conventional pumps while not requiring a pressurized liquid.

Before proceeding, it should be noted that the aforementioned pump could include two inlets as described or alternatively, the liquid and the gas could be pre-mixed prior to entry into the impellers 602, 604.

The dual phase pump 510 may have an inlet fluidly connectable to a source of water and a source of gas. In certain embodiments, the source of water and the source of gas may be a gas entrained liquid, for example, produced water. In an exemplary embodiment, the dual phase pump 510 may be configured to pressurize $CO_2$ in produced water to at least 95% dissolution in the water. Thus, the dual phase pump 510 may receive a multi-phase solution and produce a single-phase fluid of gas dissolved in water, for example, of $CO_2$ dissolved in water. In other embodiments, the source of gas and the source of liquid may be separate. In such embodiments, the dual phase pump 510 may receive a liquid and a gas and produce a single-phase fluid of the gas dissolved in the liquid.

The dual phase pumps 510 disclosed herein may be operated by varying the gas pressure. In some embodiments, the gas may be pressurized between about less than 1 psig (0.07 Bar) and about 20 psig (1.38 Bar). For instance, the gas may be pressurized at about less than 1 psi (0.07 Bar), about 1 psi (0.07 Bar), about 5 psi (0.34 Bar), about 10 psi (0.69 Bar), about 15 psi (1.03 Bar), or about 20 psi (1.38 Bar). As described in the examples, in accordance with certain embodiments, increasing gas pressure may increase gas flow while still providing a single-phase fluid. Thus, in accordance with certain embodiments, the methods disclosed herein may provide gas at a faster rate while maintaining a single-phase fluid. Similarly, the pumps may be operated by varying flow rate of the water and/or gas into the pump.

In certain embodiments, varying gas discharge pressure and/or water or gas flow rate may enable an increased gas flow rate downstream from the dual phase pump 510. The pressurized dual phase pumps 510 disclosed herein may provide a greater single-phase gas flow rate than conventional pumps. In accordance with certain embodiments, a single-phase gas flow rate of at least about 20 gpm (75.7 liters/minute), for example, of at least about 25 gpm (94.6 liters/minute), may be achieved by increasing gas discharge pressure into the dual phase pump 510. The systems and methods may be operated to produce a single-phase gas having a flow rate of at least about 15 gpm (56.8 liters/minute), at least about 20 gpm (75.7 liters/minute), at least about 25 gpm (94.6 liters/minute), or at least about 30 gpm (113.6 liters/minute).

Figure 2:
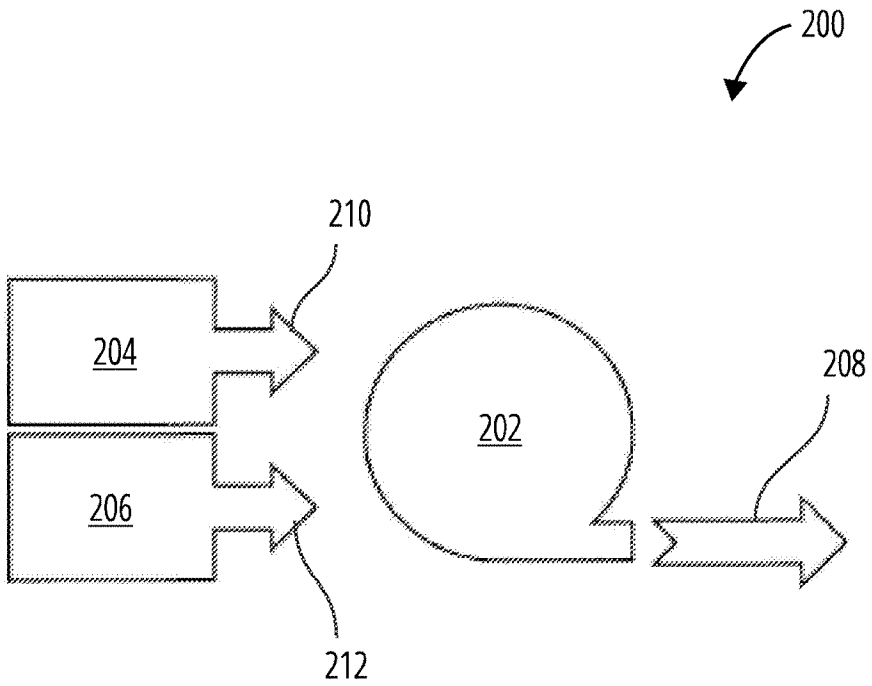
FIG. 2 illustrates a first arrangement of a dual phase pump system 200.

FIG. 2 is a schematic diagram of a first arrangement of a dual phase pump system 200 according to one embodiment. The first arrangement of a dual phase pump system 200 includes a pump 202 that has an outlet 208, a liquid inlet 210, and a gas inlet 212. The pump 202 is fluidly connectable to a source of water 204 and a source of gas 206. The pump 202 may be configured to produce a single-phase gas entrained liquid.

In one exemplary embodiment, the pump 202 and the dual phase pump 510 may be or may include a Brise™ 2.0 pump system (distributed by Siemens Water Solutions, Rothschild, Wis.).

Figure 3:
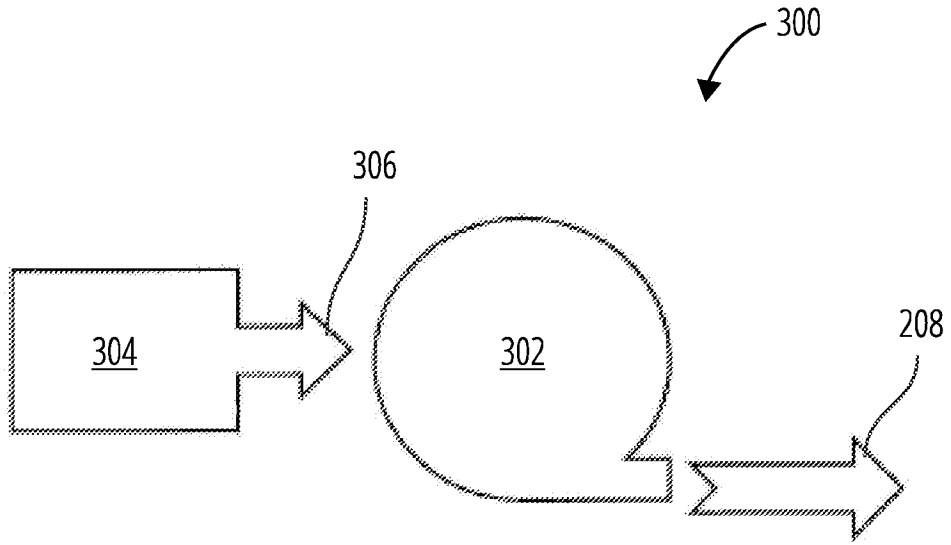
FIG. 3 illustrates a second arrangement of a dual phase pump system 300.

FIG. 3 is a schematic diagram of a second arrangement of a dual phase pump system 300 according to an alternate embodiment. The second arrangement of a dual phase pump system 300 includes a pump 302, having an inlet 306 and an outlet 208. The pump 302 is fluidly connectable to a source of multi-phase water and gas 304. The pump 302 may be configured to produce a single-phase gas entrained liquid.

The pump 302 may be employed as part of a system for gas entrainment. In accordance with certain aspects, there is provided a system for producing a single-phase gas entrained aqueous solution. The system may comprise the pump 302, as described herein, having the inlet 306 fluidly connected to a source of multi-phase water and gas 304. The system may comprise the pump 302 with the outlet 208 fluidly connected to a point of use. The point of use may be a device or system capable of receiving a single-phase gas entrained fluid. The system may comprise a flow meter configured to measure or control flow rate of one or more fluids in the system. In some embodiments, the system may comprise a valve configured or capable of controlling back-pressure of a fluid within the system.

In one exemplary embodiment, the pump 302 may be or may include a Brise™ 2.0 pump system (distributed by Siemens Water Solutions, Rothschild, Wis.).

Figure 4:
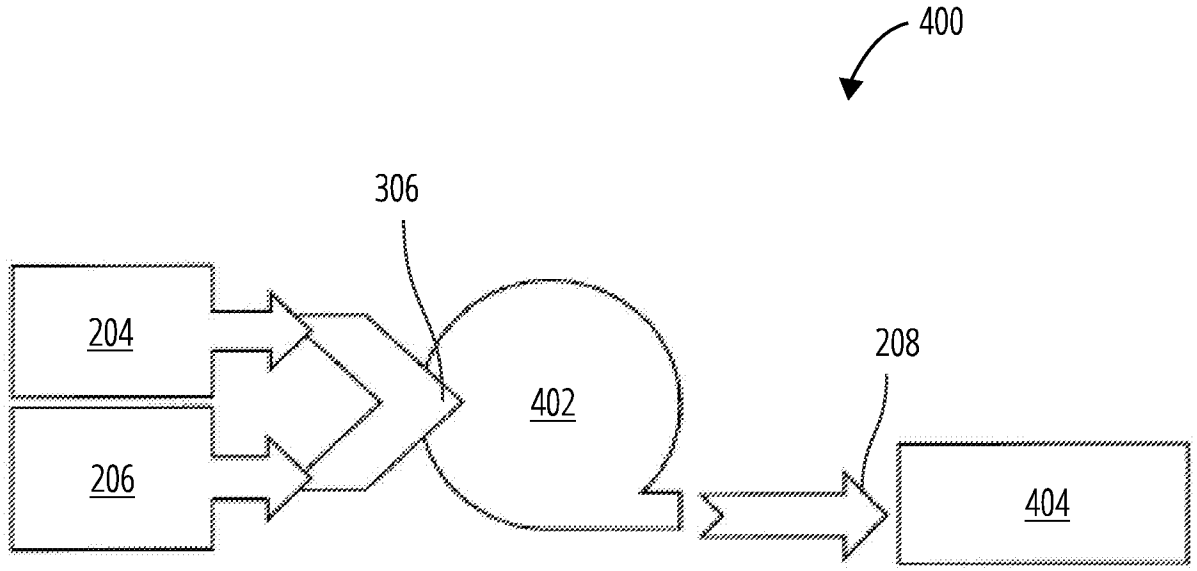
FIG. 4 illustrates a third arrangement of a dual phase pump system 400.

FIG. 4 illustrates a third arrangement of a dual phase pump system 400 capable of gas entrainment during operation. The third arrangement of a dual phase pump system 400 includes a pump 402 fluidly connected to the source of water 204 and the source of gas 206. In some embodiments, the source of water 204 and the source of gas 206 may be a single source of a multi-phase gas in liquid fluid. The pump 402 includes an outlet 208 that is fluidly connected to a point of use 404. As with the prior pumps described herein, the pump 402 may be or may include a Brise™ 2.0 pump system (distributed by Siemens Water Solutions, Rothschild, Wis.).

In accordance with an exemplary aspect, the system may be a system for enhanced oil recovery from an oil recovery well. The system disclosed herein may provide increased efficiency in oil production when compared to systems employing conventional pumps. The enhanced oil recovery system may comprise a holding tank 506 having an inlet fluidly connectable, or in practice fluidly connected, to a source of produced water comprising $CO_2$.

The system may comprise the pump 402 as previously described herein (or other pumps described herein), having an inlet 306 fluidly connected to an outlet of the holding tank 506. The pump 402 may be configured to pressurize the $CO_2$ to produce a single-phase gas entrained aqueous solution. The system may further comprise a fluid injection pump 514 having an inlet fluidly connected to an outlet 208 of the pump 402. The fluid injection pump 514 may be configured to re-inject the single-phase gas entrained aqueous solution into the oil well 502.

Typically, fluid injection pumps 514 cannot handle a multi-phase stream or the fluid injection pumps 514 may cavitate and fail. Thus, the discharge from the pumps 202, 302, 402, 510 disclosed herein may generally be solubilized in an amount sufficient to avoid cavitation or failure of a downstream fluid injection pump 514. In some embodiments, the discharge may be a single-phase dissolved $CO_2$ aqueous solution.

An exemplary system for enhanced oil recovery from an oil well 500 is shown in FIG. 5. As discussed, the system for enhanced oil recovery from an oil well 500 includes a three-phase separator 504 which separates gas and hydrocarbon (HC) liquid from an aqueous solution. The aqueous solution moves downstream to the holding tank 506 including a primary water tank and a secondary water tank. In the holding tank 506, $CO_2$ separates from the produced water and resides in the head space 516, forming a multi-phase fluid. The multi-phase fluid is transferred to a plurality of pumps including the dual phase pump 510 and the transfer pumps 512. In an exemplary embodiment shown in FIG. 5, a damaged or degraded transfer pump 520 is taken offline for maintenance. The dual phase pump 510 is positioned to replace the damaged or degraded transfer pump 520 during maintenance. The multi-phase fluid is pressurized by the dual phase pump 510 to form a single-phase fluid. Downstream, the fluid is injected into the oil well 502 by water injection pumps 514. The exemplary system for enhanced oil recovery from an oil well 500 of FIG. 4 shows a series of pumps, where the dual phase pump 510 is positioned to replace the damaged or degraded transfer pump 520 while it is undergoing maintenance. However, in other embodiments, one or more dual phase pumps 510 may be used to pressurize the multi-phase fluid, for example, instead of the series of transfer pumps 512.

Thus, certain embodiments disclosed herein comprise employing a dual phase pump 510 in an oil recovery system to entrain $CO_2$ in water and deliver a single-phase stream directly to re-injection pumps 514 during maintenance interruptions. The result is a cost-effective option, compared to bringing in temporary vapor recovery units 508. The dual phase pump 510 can entrain, pressurize, and solubilize the $CO_2$ into a single-phase stream that can be sent directly to the re-injection pumps 514 to be then be injected into the oil well 502.

The pumps 202, 302, 402, 510 disclosed herein may improve maintenance operations by replacing offline vapor recovery units 508 with a single pressurizing pump 202, 302, 402, 510. If few enough pumps 202, 302, 402, 510 can be used to replace the offline vapor recovery units 508, there may be substantial cost savings, reduced footprint, and reduced energy demand.

In accordance with another aspect, there is provided a method of facilitating gas re-injection during enhanced oil recovery. The method may comprise providing a pump 202, 302, 402, 510 as disclosed herein. The method may comprise fluidly connecting the pump 202, 302, 402, 510 to an enhanced oil recovery system, as described herein. For example, the method may comprise fluidly connecting the pump 202, 302, 402, 510 to a source of produced water comprising $CO_2$ and/or to a fluid injection pump 514 configured to reinject the single-phase gas entrained solution into an oil recovery well. The method may comprise instructing a user to fluidly connect the pump 202, 302, 402, 510, as disclosed herein.

In certain embodiments, the method may comprise instructing a user on how to operate the pump 202, 302, 402, 510. For example, the methods may comprise instructing a user to operate the pump 202, 302, 402, 510 at a certain flow rate and/or with a certain backpressure.

In accordance with yet another aspect, there is provided a method of retrofitting a gas injection enhanced oil recovery system comprising a fluid injection pump 514. The method may comprise providing a pump 202, 302, 402, 510, fluidly connecting the pump 202, 302, 402, 510, and/or instructing a user, as previously described.

In certain embodiments, the systems and methods disclosed herein may be applied to any application where $CO_2$ needs to be recovered or disposed. In enhanced oil recovery processes, $CO_2$ recovery and discharge are regulated by state agency. It is noted that the methods disclosed herein could be used to solubilize any gas up to its solubility limit, for example, for recovery or discharge.

Having thus described several aspects of at least one embodiment of this invention, it is to be appreciated various alterations, modifications, and improvements will readily occur to those skilled in the art. Such alterations, modifications, and improvements are intended to be part of this disclosure and are intended to be within the spirit and scope of the invention. Accordingly, the foregoing description and drawings are by way of example only.

EXAMPLES

An experimental system was prepared and operated to test gas entrainment performance of a pressurizing pump. The experimental system tested dissolution of $CO_2$ in water. It was not known if the $CO_2$ would dissolve quickly enough to meet the needs of an enhanced oil recovery system.

The system included a water source and a $CO_2$ bank fluidly connected to a pressurizing pump. The pump was a Brise™ 2.0 pump. The fluid conduit downstream of the pump was clear, to allow observation of the entrained fluid. A valve was positioned downstream from the pump to control backpressure. The valve provided fluid connection to a downstream booster pump. The entrained fluid was recycled or sent to a drain.

The system was tested with $CO_2$ at varying pressures of 1 psig (0.069 Bar) and 15 psig (1.03 Bar). The control gas was air. The fluid used for testing was water at a temperature of 60° F. (15.6 degrees Celsius), specific gravity of 1, and viscosity of 1 cP. The pump was operated at a speed of 3600 rpm.

The results are presented in Table 2 and the graphs of FIGS. 5A and 5B.

TABLE 2

Test Run Results

| Run | Suction Pressure (psig) | Discharge Pressure (psig) | Water Flow (gpm) | Gas Flow (SCFH) | Gas Flow (gpm) |
|---|---|---|---|---|---|
| 1 | −3.4 | 60 | 78.8 | 47.0 | 5.9 |
| 2 | −3.4 | 60 | 78.2 | 145.8 | 18.2 |
| 3 | −3.9 | 60 | 78.1 | 194.4 | 24.2 |
| 4 | −3.4 | 80 | 53.0 | 22.0 | 2.7 |
| 5 | −1 | 80 | 54.2 | 121.5 | 15.1 |
| 6 | −1 | 80 | 54.4 | 170.1 | 21.2 |
| 7 | 0 | 100 | 33.0 | 15.0 | 1.9 |
| 8 | 0 | 100 | 31.7 | 109.4 | 13.6 |
| 9 | 0.5 | 100 | 32.5 | 145.8 | 18.2 |

| Run | Gas/ Water % | Gas | SCFH Gas Flow Comparison | Comments | Differential Pressure (psi) |
|---|---|---|---|---|---|
| 1 | 7.4 | Air | | 2 phase | 63.4 |
| 2 | 23.2 | $CO_2$ 1 psi | 3.1 × air draw | 1 phase | 63.4 |
| 3 | 31.0 | $CO_2$ 15 psi | 4.1 × air draw | 1 phase | 63.9 |
| 4 | 5.2 | Air | | 2 phase | 83.4 |
| 5 | 27.9 | $CO_2$ 1 psi | 5.5 × air draw | 1 phase | 81.0 |
| 6 | 39.0 | $CO_2$ 15 psi | 7.7 × air draw | 1 phase | 81.0 |
| 7 | 5.7 | Air | | 2 phase | 100.0 |
| 8 | 43.0 | $CO_2$ 1 psi | 7.3 × air draw | 1 phase | 100.0 |
| 9 | 55.9 | $CO_2$ 15 psi | 9.7 × air draw | 1 phase | 99.5 |

Briefly, it was determined that not only was the $CO_2$ and water discharge fluid always single-phase, but also the gas flow significantly increased when using $CO_2$ as compared to air, which was not anticipated prior to testing. The increase in gas flow ranged between three to seven times greater than that of air, varying with discharge pressure. The increase was even greater, between four to ten times greater, when the $CO_2$ source was maintained at about 15 psig (1.03 Bar) pressure.

The increase in $CO_2$ gas flow obtained with the Brise™ 2.0 pump enables fewer pumps to replace the temporary VRU, making the application more economical, reducing footprint of the system, and reducing an energy demand of the system. Due to the Brise™ 2.0 impeller design, and the mixing action it creates in the pump, the high $CO_2$ gas flow is possible while still maintaining the single-phase discharge.

Thus, $CO_2$ may be entrained in water to form a single-phase fluid with the systems and methods disclosed herein. It is expected that systems entraining other gases having a greater solubility than air will have similar results. In particular, it is expected that systems entraining other gases having a greater solubility than $CO_2$ will have similar results.

While specific embodiments have been discussed, the above specification is illustrative and not restrictive. Many variations will become apparent to those skilled in the art upon review of this specification and the claims below. The full scope should be determined by reference to the claims, along with their full scope of equivalents, and the specification, along with such variations.

Certain embodiments are within the scope of the following claims.

What is claimed is:

1. A pump system comprising:

a centrifugal pump including:

an impeller;

a first inlet arranged to receive a first flow of liquid;

a second inlet arranged to receive a flow of gas at a first pressure, the gas being soluble in the liquid, the impeller operable to combine the first flow of liquid and the flow of gas into a second flow of liquid; and an outlet arranged to discharge the second flow of liquid that contains the flow of gas solubilized therein; and an injection pump having a discharge and an inlet arranged to receive the second flow of liquid, the injection pump operable to increase the pressure of the second flow of liquid to produce a third flow of liquid, and to discharge the third flow of liquid through the discharge.

2. The pump system of claim 1, further comprising a holding tank that contains a liquid and a gas that has de-solubilized from the liquid.

3. The pump system of claim 2, further comprising a three-phase separator positioned to receive a produced fluid mixture including a hydrocarbon liquid, the gas, and the liquid, the three-phase separator including a gas outlet, a separate hydrocarbon outlet, and a third outlet that directs liquid to the holding tank, the liquid including the gas solubilized in the liquid.

4. The pump system of claim 1, wherein the impeller includes a dual-sided impeller having a first side arranged to receive the first flow of liquid from the first inlet and a second side arranged to receive the flow of gas from the second inlet, the impeller operable to solubilize the flow of gas into the first flow of liquid to define the second flow of liquid.

5. The pump system of claim 1, wherein the first pressure is between 1 psig and 20 psig.

6. The pump system of claim 1, wherein the liquid in the first flow of liquid includes water and the gas in the flow of gas contains carbon dioxide.

7. The pump system of claim 6, wherein the carbon dioxide is at least 95 percent solubilized in the second flow of liquid.

8. A method of operating a pump system, the method comprising:

directing a first flow of liquid to a centrifugal pump;

directing a flow of gas at a first pressure to the centrifugal pump, the flow of gas being soluble in the liquid;

rotating an impeller in the centrifugal pump to increase the pressure of the first flow of liquid and the flow of gas and to combine the first flow of liquid and the flow of gas into a second flow of fluid;

discharging the second flow of liquid that contains the flow of gas solubilized therein;

directing the second flow of liquid to an injection pump; and operating the injection pump to inject the second flow of liquid into an oil well to enhance oil production.

9. The method of claim 8, further comprising collecting a liquid and a gas that has de-solubilized from the liquid in a holding tank, and directing the gas to the centrifugal pump as a portion of the flow of gas and directing the liquid to the centrifugal pump as a portion of the first flow of liquid.

10. The method of claim 9, further comprising receiving a produced mixture in a three-phase separator from the oil well, the produced liquid including a hydrocarbon liquid, the gas, and the liquid, wherein the three-phase separator includes a gas outlet, a separate hydro-carbon outlet, and a third outlet for directing liquid to the holding tank, the liquid including the gas solubilized in the liquid.

11. The method of claim 8, wherein the impeller includes a dual-sided impeller, and wherein the first flow of liquid is directed to a first side of the impeller and the flow of gas is directed to a second side of the impeller.

12. The method of claim 11, further comprising rotating the impeller to solubilize the flow of gas into the first flow of liquid to define the second flow of liquid.

13. The method of claim 8, wherein the first pressure is between 1 psig and 20 psig.

14. The method of claim 8, wherein the liquid in the first flow of liquid includes water and the gas in the flow of gas contains carbon dioxide.

15. The method of claim 14, wherein the carbon dioxide is at least 95 percent solubilized in the second flow of liquid.

16. A pump system comprising:

a three-phase separator positioned to receive a produced fluid mixture from an oil well, the fluid mixture including a hydrocarbon liquid, a gas, and water, the three-phase separator including a gas outlet, a separate hydrocarbon outlet, and a water outlet;

a holding tank positioned to receive the water from the water outlet, the water including a quantity of solubilized gas that de-solubilizes in the holding tank such that the holding tank contains separated water and gas;

a centrifugal pump including:

a dual sided impeller including a first side impeller and a second side impeller coupled to one another for co-rotation;

a first inlet arranged to receive a first flow of water from the holding tank and to direct the first flow of water to the first side impeller;

a second inlet arranged to receive a flow of gas from the holding tank at a first pressure and to direct the flow of gas to the second side impeller, the dual sided impeller operable to combine the first flow of water and the flow of gas into a second flow of liquid; and an outlet arranged to discharge the second flow of liquid that contains the flow of gas solubilized therein; and an injection pump having an inlet arranged to receive the second flow of liquid, a working member operable to increase the pressure of the second flow of liquid to produce a third flow of liquid, and an outlet arranged to discharge the third flow of liquid to the oil well.

17. The pump system of claim 16, wherein the first pressure is between 1 psig and 20 psig, and wherein the flow of gas contains carbon dioxide.

18. The pump system of claim 17, wherein the carbon dioxide is at least 95 percent solubilized in the second flow of liquid.

* * * * *